US008442244B1

(12) United States Patent
Long, Jr.

(10) Patent No.: US 8,442,244 B1
(45) Date of Patent: May 14, 2013

(54) SURROUND SOUND SYSTEM

(76) Inventor: Marshall Long, Jr., Sherman Oaks, CA (US)

( * ) Notice: Subject to any disclaimer, the term of this patent is extended or adjusted under 35 U.S.C. 154(b) by 764 days.

(21) Appl. No.: 12/583,540

(22) Filed: Aug. 22, 2009

(51) Int. Cl.
*H04R 25/00* (2006.01)

(52) U.S. Cl.
USPC ..... 381/307; 381/26; 381/309

(58) Field of Classification Search ..... 381/1, 309, 381/310, 300, 17–19, 28, 71.1, 71.6, 77, 381/89, 107, 120, 26, 74, 59, 95, 96; 700/94
See application file for complete search history.

(56) References Cited

U.S. PATENT DOCUMENTS

| | | | | |
|---|---|---|---|---|
| 4,262,170 | A | 4/1981 | Bauer | |
| 4,399,334 | A | 8/1983 | Kakiuchi et al. | |
| 4,631,962 | A | 12/1986 | Genuit | |
| 4,741,035 | A | 4/1988 | Genuit | |
| 5,438,623 | A | 8/1995 | Begault | |
| 5,497,425 | A | 3/1996 | Rapoport | |
| 5,742,689 | A | 4/1998 | Tucker et al. | |
| 6,118,875 | A | 9/2000 | Moller et al. | |
| 6,118,876 | A | 9/2000 | Rusicka | |
| 6,263,085 | B1 | 7/2001 | Weffer | |
| 6,356,644 | B1 | 3/2002 | Pollak | |
| 6,810,987 | B1 | 11/2004 | DeKalb | |
| 6,851,512 | B2 | 2/2005 | Fox et al. | |
| 6,904,152 | B1 | 6/2005 | Moorer | |
| 6,937,737 | B2 | 8/2005 | Polk, Jr. | |
| 7,155,025 | B1 | 12/2006 | Weffer | |
| 7,340,272 | B2 | 3/2008 | Kim | |
| 7,545,946 | B2 | 6/2009 | Melanson | |
| 7,558,393 | B2 | 7/2009 | Miller, III | |
| 2003/0021423 | A1 * | 1/2003 | Wood | 381/18 |
| 2003/0190047 | A1 * | 10/2003 | Aarts | 381/310 |
| 2007/0172086 | A1 * | 7/2007 | Dickins et al. | 381/309 |
| 2007/0183608 | A1 * | 8/2007 | Willems | 381/307 |
| 2007/0286427 | A1 * | 12/2007 | Jung et al. | 381/17 |
| 2008/0159571 | A1 | 7/2008 | Hooley | |

* cited by examiner

*Primary Examiner* — Vivian Chin
*Assistant Examiner* — Friedrich W Fahnert
(74) *Attorney, Agent, or Firm* — J. E. McTaggart

(57) ABSTRACT

A surround sound system acquires a set of original channel signals as picked up or modeled by a set of microphones, located in a real or virtual acoustic space. Two microphones, mounted on or near the front of a head that may be real or artificial, are oriented to pick up the sounds emanating from the front. Two additional microphones are located near the ear canals of the head configured to emulate a human head in a manner that encodes the surround sound signals with a head-related transfer function (HRTF) that, in reproduction, enhances the accuracy and realism with which a listener perceives the various source locations. The head can be augmented, e.g. with small baffles strategically configured and located to modify the HRTF for overall accuracy and realism. Surround sound channels, so originated, may be transmitted for real-time reproduction or may be recorded, filtered, delayed, or otherwise processed and stored in memory for later reproduction. In an exemplary 4.0 surround sound listening system the listener is located facing a L/R pair of front loudspeakers and fitted with a L/R pair of small earbud loudspeakers located one at each ear near the canals in an aurally transparent manner that preserves normal hearing, e.g. with regard to the front channels. The listener experiences realistic perception of XY locations of various sound sources reproduced as originally located.

16 Claims, 2 Drawing Sheets

SURROUND SOUND SYSTEM

FIELD OF THE INVENTION

The present invention is in the field of multi-channel audio sound recording and reproduction, and more particularly it is a sound system including pickup, processing, storing, and realistically reproducing surround sound. An exemplary 4.0 surround sound system embodiment utilizes a live pickup consisting of a set of four microphones mounted on a head portion of a support structure or human subject to receive both front originating and side and rear originating sounds. The latter include the spatial effects due to the head, generally known as head-related transfer functions (HRTF). The reproduction system utilizes two (or more) front (Center) Right/Left loudspeakers and a pair of Right/Left ear-located small loudspeakers for realistic perception of the surround sound field. The sound field can also be generated artificially by computer modeling.

BACKGROUND OF THE INVENTION

Following the natural progression from monaural sound to the universal acceptance of stereo sound in many aspects of professional and entertainment audio, surround sound is furthering this progression in an emerging stage of development.

Stereo sound generally provides the listener with the perception of a sound stage extending between and somewhat beyond the angle of the two loudspeakers, typically located at angles+/−30 degrees from the listener's forward axis. Human binaural hearing is able to perceive the direction of a sound source by comparing the arrival time of the sound at each ear, due to the separation of the listener's ears causing a geometric difference in the length of the off-axis sound path and by interpreting the difference in sound level presented to each ear. In sound reproduction the sound direction using only a pair of loudspeakers is controlled by panning, or controlling the volume of each loudspeaker, either by using directional microphones during recording or by manipulating the process after recording.

While in most stereo listening experiences there is little or no perception of the acoustic space, in the better recordings there can be a sense of a sound stage in front of the listener, where a sensation of depth can be achieved. The creation of a surround sound environment using loudspeakers usually requires additional loudspeakers around the listener to fill in the sounds coming from the side and rear. This has lead to the commonly used formats designated 5.1, 5.2, 7.2, etc. in movie and home theater applications. These all-loudspeaker systems seek to not only expand the angle of the sound stage from about 60 degrees to full 360 degrees, but also to provide the listener with greater perception of source distance, and thus a more realistic perception of the acoustic space.

Binaural perception of the distance to a sound source is highly dynamic and complex, involving many subtle and/or subjective factors that vary with the source distance, e.g., small inter-channel/binaural differences in loudness, deviations from expected familiar patterns of harmonic content in music and in speech due to the loss of high frequency information along with attenuation as a function of distance, and reverberant field contributions due to room acoustics (both in origination and in reproduction) involving direct-to-reverberant ratios controlled by the room.

There have also been many attempts to reproduce a three dimensional sound field through the use of binaural or dummy head recording along with headphone playback. These generally require careful attention to the recording chain and are sensitive to breaks in the process. The primary difficulty encountered with this technique is that sounds that originate from in front of the head are perceived by the listener as originating inside his head. Thus frontal sounds are poorly localized. Clearly the two reproduction techniques, loudspeakers and headphones each have an area where they are preferred: loudspeakers for front sounds and headphones for side and rear sounds.

DISCUSSION OF PRIOR ART

U.S. Pat. No. 7,558,393, SYSTEM AND METHOD FOR COMPATIBLE 2D/3D (FULL SPHERE WITH HEIGHT) SURROUND SOUND REPRODUCTION by Robert E. Miller III, discloses a method of producing an output sound field that is representative of an input sound field compatible with both ITU 5.1/6.1. To produce a 3D spherical field, some loudspeakers may not be located in the 2D plane of the listener. A minimum of 10 loudspeakers is deemed necessary for realistic 3D surround sound; a 12 loudspeaker embodiment utilizes 2 front loudspeakers, 2 rear loudspeaker and 8 satellite quality ambiance loudspeakers. Discussion includes HRTF (head related transfer function) and ILD (intra-aural level difference).

U.S. Pat. No. 7,367,886 GAMING SYSTEM WITH SURROUND SOUND by Timothy C. Loose, assigned to WMS Gaming, Inc., discloses a gaming terminal that conducts a wagering game, showing a user seat facing a gaming terminal with a pair of near-field front loudspeakers in the terminal and a pair of very-near-field rear loudspeakers mounted on the back of the user seat.

U.S. Pat. No. 7,340,272 MOBILE COMMUNICATIONS TERMINAL HAVING A THREE-DIMENSIONAL SURROUND SOUND EFFECT AND ITS CONTROL METHOD by Dong-Sub Kim, assigned to Samsung Electronics, utilizes a stereo input L/R level comparator and an audio controller to control phase delays in first and second audio paths in both stereo channels. An example shows only 2 loudspeakers: L. and R.

U.S. Pat. No. 7,155,025 for SURROUND SOUND HEADPHONE SYSTEM by Weffer discloses a headphone assembly including a pair of earpieces each having at least two loudspeakers.

U.S. Pat. No. 6,904,152 to Moorer, assigned to Sonic Solutions, for MULTI-CHANNEL SURROUND SOUND MASTERING AND REPRODUCTION TECHNIQUES THAT PRESERVE SPATIAL HARMONICS IN THREE DIRECTIONS discloses techniques of making a recording of or transmitting a sound field from either multiple monaural or directional sound signals that reproduce through multiple discrete loudspeakers a sound field with spatial harmonics that substantially exactly match those of the original 2D/3D sound field. Signals may be rematrixed to compensate for differences in the reproduction location relative to the original sound field.

U.S. Pat. No. 6,851,512 MODULAR MICROPHONE ARRAY FOR SURROUND SOUND RECORDING by Fox et al. discloses a method and microphone mounting system that facilitates surround sound multichannel recording, showing five microphones in a uniform radial array.

U.S. Pat. No. 6,810,987 for EARBUD HEADSET by DeKalb assigned to Plentronics, Inc., shows a monaural headset including a microphone.

U.S. Pat. No. 6,356,644 for EARPHONE (SURROUND SOUND) SPEAKER by Pollak assigned to Sony Corp. discloses a headphone set including casings that contain at least two speakers. A surrounding pad isolates the ear from external sound.

U.S. Pat. No. 6,263,085 for SURROUND SOUND HEADPHONES by Weffer.

U.S. Pat. No. 4,741,035 for WIDE BAND, LOW NOISE ARTIFICIAL HEAD FOR TRANSMISSION OF AURAL PHENOMENA to Genuit includes free-field sound exposure from the front to enable measurements comparable to a measurement microphone.

U.S. Pat. No. 4,631,962 for ARTIFICIAL HEAD MEASURING SYSTEM to Genuit discloses an artificial head for acoustic measuring, including shoulder, head and ears on both sides with microphones disposed in the auditory canals U.S. Pat. No. 4,262,170 MICROPHONE SYSTEM FOR PRODUCING SIGNALS FOR SURROUND-SOUND TRANSMISSION AND REPRODUCTION by Bauer discloses a system including a compact array of microphones in combination with signal-combining circuitry, especially suited for use with surround-sound sources.

OBJECTS OF THE INVENTION

It is a primary object of the invention to provide a surround sound system that gives a listener a realistic perception of both angle and distance of sound sources at different locations within a designated sound field as well as a sense of the acoustic space.

It is a further object to provide the structure including a cluster of at least four real or synthetic microphones, two directed to the front and two located on either side of a head located in the sound field, in a manner to enable a set of channels, one from each microphone, to accurately reproduce the surround sound including the angle and distance of the corresponding sound sources.

It is a still further object to provide the structure and associated method of reproducing the sound from at least four surround sound channels, particularly sound channels originated in accordance with the present invention, in a manner to provide a listener with a perception of sound source angles and distances that replicate the original sound sources with accuracy that closely approximates the original.

SUMMARY OF THE INVENTION

The foregoing objects have been accomplished in a surround sound system that acquires a set of original sound channels as picked up by a set of microphones located in an actual or in a computer modeled acoustic space. The microphones are located on or near a real head or an artificial head that is made and configured to emulate acoustic properties of a human head in a manner to encode the surround sound signals with a head-related transfer function (HRTF) that, in reproduction, determines the accuracy and realism with which a listener is perceives the various source locations of original sounds. The head shape can be modified, e.g., with small baffles strategically configured and located to modify the HRTF for overall realism. Surround sound channels thusly originated may be recorded on suitable storage media for later reproduction.

Alternatively the channels can be transmitted for real-time reproduction. In an exemplary 4.0 surround sound listening system the listener is located facing a L/R pair of front loudspeakers and fitted with a L/R pair of small ear channel loudspeakers each located near the outer end of the auditory passageways in an aurally-transparent manner that does not interfere with normal hearing, e.g., with regard to the front channels. The listener experiences realistic perception of XY locations of various point sound sources reproduced as originally located anywhere in the acoustic space with a degree of accuracy imparted by the HRTF.

Alternatively the channels can be created synthetically by manipulating the signals electronically so as to recreate the effects of forward, side, rear or other sound directions either by post processing prerecorded sounds or by computer modeling the acoustic space.

DETAILED DESCRIPTION

Figure 1:
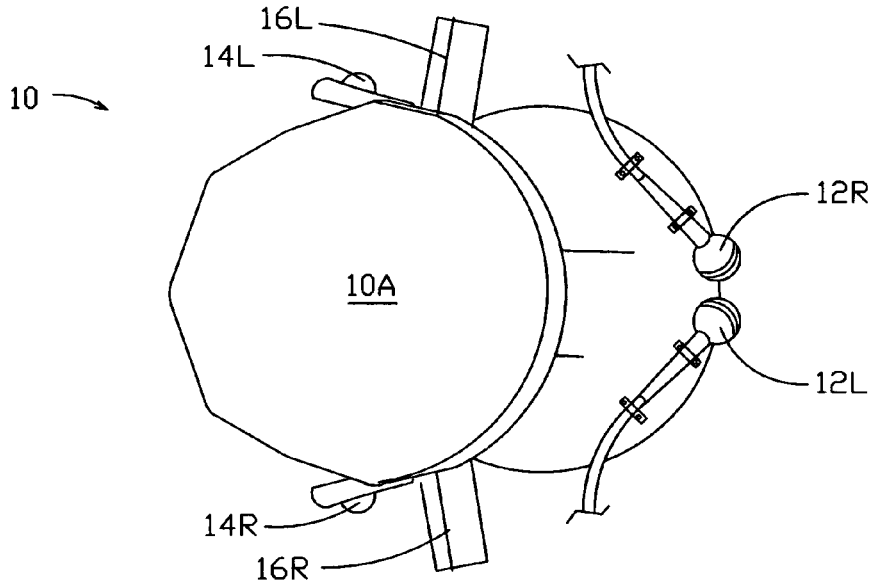
FIG. 1 is a top view of an artificial head configured and fitted with four microphones made and arranged to pickup surround sound in accordance with an exemplary embodiment of the present invention.

FIG. 1 is a top view of an artificial head 10, located in an acoustic space, supported at a selected head height, and fitted with four microphones made and arranged to pickup 4.0 surround sound in accordance with an exemplary embodiment of the present invention. Mounted on the front of a visor of a fabric cap 10A are a pair of microphones 12L, on the right side facing to the left and 12R, on the left side facing to the right. Microphones 12L and 12R are of the cardioid-directional-response type. Mounted at the two ear locations of head 10 are a pair of omni-directional-response microphones 14L and 14R. These four microphones are connected via cables to four corresponding pre-amplifier units that provide the signals to be recorded or transmitted live.

Immediately forward of the ear regions, a pair of sound baffles 16L and 16R are mounted to extend as shown, as an artifice to increase the accuracy and uniformity in the perception of direction of various sources. There can be considerable variation in the size of these baffles as they are developed empirically.

Figure 2:
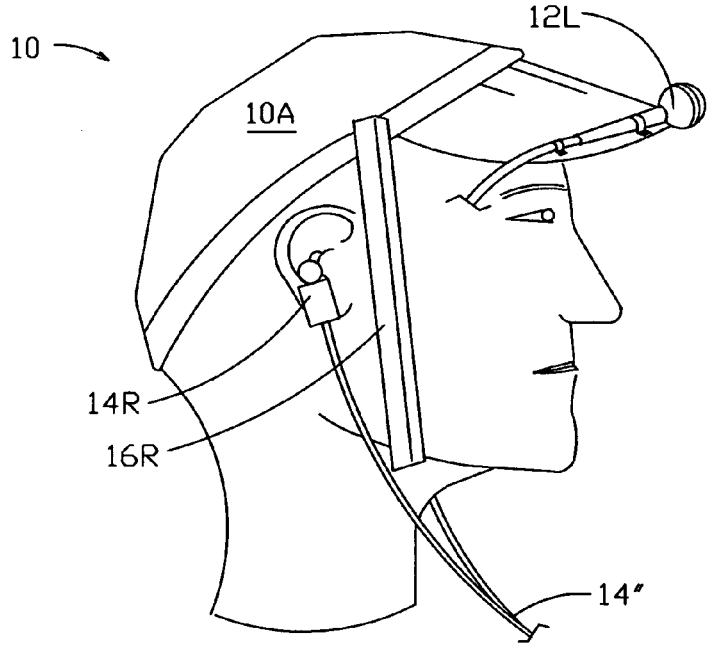
FIG. 2 is a side view profile of the artificial head of FIG. 1.

FIG. 2 is a right hand side view profile of the head 10 of FIG. 1 showing microphone 12L mounted on the right hand side of the visor of cap 10A, right hand ear microphone 14R mounted in the right hand ear region and right hand sound baffle 16R mounted immediately forward of right ear microphone 14R.

The material, location, and dimensions of sound baffles 16L and 16R are derived empirically as an artifice to modify the HRTF effect in a manner that provides increased accuracy in perception of the angle of sound sources particularly those in a range around 70 degrees from the front axis. In an experimental prototype, good results were obtained with baffles 16L and 16R located as shown, made from corrugated cardboard.

Figure 3:
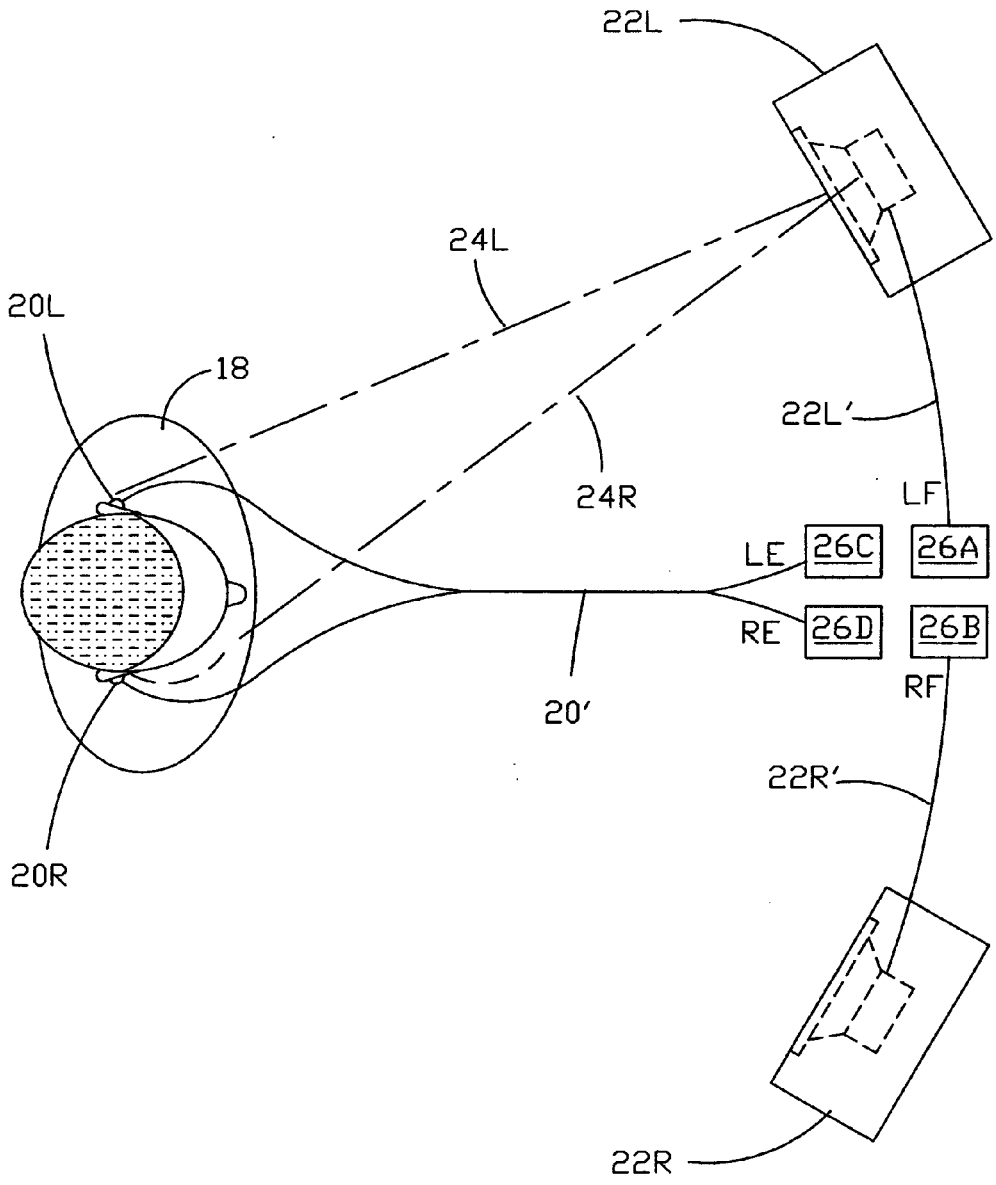
FIG. 3 is a top view of a listener in a surround sound listening system in accordance with an exemplary 4.0 embodiment of the present invention.

FIG. 3 is top view of a listener 18 located in an exemplary 4.0 surround sound listening system in accordance with the present invention. Facing listener 18 and offset symmetrically from a forward axis by about 30 degrees, a pair of front stereo loudspeakers 22L and 22R are typically located as in a work station, desk, game, or entertainment environment. Two direct sound paths 24L and 24R are shown in an example originating at loudspeaker 22L: path 24L to the left ear and the longer path 24R to the right ear. Human binaural hearing uses the small amount of time delay and level reduction to the longer path ear, to provide the listener 18 with the perception of the source angle corresponding to that of the original source in the acoustic space. The loudspeakers are connected by cables, 22L' and 22R', to corresponding output terminals 26A (Left Front) and 26B (Right Front) of two audio amplifiers receiving as inputs the corresponding two front sound channel signals from the head microphone cluster of FIG. 1 or from recorded storage media.

FIG. 3 also shows listener 18, fitted with a headset having a pair of earbud or other small aurally transparent transducers 20L and 20R, located one at each outer ear region near the auditory passageways in a manner that does not interfere with normal hearing, e.g., with regard to the front channels. Transducers 20L and 20R are connected by cables in flexible cord 20' to output terminals 26C (Left Ear) and 26D (Right Ear) of two audio amplifiers receiving as inputs the corresponding two ear sound channel signals including related HRTF information from the head microphone cluster of FIG. 1 or from recorded storage media. The accuracy of this directional perception depends upon the conditions and integrity of the original surround sound pickup and processing, and preservation thereof in any intervening transmission and/or memory storage. As the distance between the front loudspeakers and the listener increases, the signal sent to the headphone loudspeakers may have to be delayed or otherwise processed to retain the proper relationship to the front loudspeaker sounds.

It is common practice to augment a stereo or surround sound system by the addition of a sub-woofer channel signal, amplifier, and loudspeaker. It is generally accepted that sound at the low end of the audio spectrum adds little if any benefit to the perception of direction or distance in stereo or surround sound. Thus a subwoofer channel is not considered to be one of the surrounding satellite loudspeakers, and is generally regarded as separate and independent. An exemplary four channel surround sound system embodiment of the present invention could be augmented from 4.0 to 4.1 by the addition of one or more sub-woofer channels with corresponding pickup, storage, processing, transmission, and reproduction including the sub-woofer loudspeaker. Common practice is to imbed the sub-woofer channel in one of the other channels and to separate the information by filtering.

As an alternative to practicing the invention in actuality as disclosed, the principles of the invention can also be practiced or refined in a virtual manner, e.g. for research and development purposes, by computer modeling simulating virtually any element of the invention including the acoustic space, microphones, the head, DSP effects such as reverberation, the reproduction system, loudspeakers and listening environment, and even including the human listener. The scope of the invention is intended to cover such simulations of any claim element under a doctrine of equivalents.

It is to be understood that while the "head" will typically be implemented as an artificial head, the invention can be practiced in an equivalent manner utilizing a head of a live human to perform the HRTF function, e.g. the helmeted head of a sports player, motorcyclist or actor.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions, and changes that come within the meaning and range of equivalency of the claims are therefore intended to be embraced therein.

What is claimed is:

1. A surround sound system, for recording and realistic reproduction simulating original surround sound, comprising:

a set of microphones, mounted on microphone support structure including a head portion configured to support the set of microphones in predetermined locations for surround sound recording in a designated acoustic space:

said set of microphones including first and second microphones having generally cardioid directivity, located in an upper frontal region of said head portion and oriented generally horizontally and forwardly at a contained angle of about 90 degrees so as to provide left and right front channel signals respectively; and third and fourth microphones having generally omnidirectional directivity, located at left and right ear locations of the head portion so as to provide left and right ear surround sound channel signals respectively;

said set of microphones constituting a surround sound signal source providing a set of surround sound channel signals to be processed in a manner so as to include head-related transfer function (HRTF) information relating to the influence of the head portion on sound patterns at the location of each microphone in the designated acoustic space associated with the signal source;

an audio processing system, receiving as input the set of sound channel signals, made and arranged to process the set of sound channel signals encoded with the HRTF information and to amplify the processed signals in a predetermined manner to provide as output a corresponding set of loudspeaker signals;

in a surround sound reproduction system, a set of front loudspeakers disposed in front of a listener, receiving a front-related portion of the loudspeaker signals; and a set of small loudspeakers located in close proximity to the listener's ear canals, receiving a side-and-rear-related portion of the loudspeaker signals.

2. The surround sound system defined in claim 1 wherein the set of sound channel signals comprises:

a left front channel signal originating from a the first one of said set of microphones;

a right front channel signal originating from a the second one of said set of microphones;

a left ear channel signal originating from a the third one of said set of microphones; and a right ear channel signal originating from a the fourth one of said set of microphones.

3. The surround sound system defined in claim 2, wherein:

said set of front loudspeakers comprises a left front loudspeaker receiving said left front channel signal and a right front loudspeaker receiving said right front channel signals; and said set of small loudspeakers comprises a left ear transducer located at the listener's left ear, receiving the left ear channel signal, and a right ear transducer, located at the listener's right ear, receiving the right ear channel signal, each said transducer being located in an exterior region of the listener's corresponding ear near the ear canal but offset therefrom so as not to impact the listener's normal hearing function;

whereby the listener is enabled to accurately perceive direction and distance of various source sounds, along with characteristics of the acoustical space.

4. The surround sound system, as defined in claim 3 wherein said set of small loudspeakers is deployed as a headset including means for delivering the surround sound signals to the headset transducers.

5. The surround sound system, as defined in claim 4 wherein the means for delivering the surround sound signals to the headset transducers comprises a flexible cord set.

6. The surround sound system, as defined in claim 4 wherein the means for delivering the surround sound signals to the headset transducers comprises a wireless link.

7. The surround sound system, as defined in claim 1 wherein said first and second microphones are supported on a stiff peak of a cap placed over the head portion.

8. The surround sound system, as defined in claim 1 wherein:

the head portion comprises a sound-opaque artificial head of size and shape generally approximating that of human head, supported at a typical height of a human head, and shaped to optimize HRTF effects for accuracy of angle and distance perception.

9. The surround sound system, as defined in claim 8, further comprising:

a pair of flat generally rectangular sound baffles of designated dimensions, made from designated material and attached each to an opposite side of the artificial head at a location forward of a corresponding ear location, oriented generally vertically and extending from the artificial head in a general radial direction relative to a vertical central axis of the artificial head; and said pair of baffles being of material, size and location determined empirically to optimize the HRTF for uniformity and accuracy regarding perception of angle and distance of original sounds in the acoustic space.

10. The surround sound system, as defined in claim 1 wherein the microphone support structure comprises a human person and the head portion comprises the person's head including microphone-holding structure.

11. The surround sound system, as defined in claim 10 wherein said microphone-holding structure comprises a helmet worn on the human head and fitted with said set of microphones.

12. The surround sound system, as defined in claim 1 wherein said audio processing system further comprises:

an audio recording system made and arranged to record and store a set of surround sound channel signals from the sound signal source in a memory medium, and to deliver the set of surround sound channel signals on demand for purposes of reproduction in a listener environment.

13. The surround sound system, as defined in claim 1 wherein said surround sound signal source comprises audio synthesis and digital sound processing equipment made and arranged to synthesize, process and deliver said set of surround sound signals with the first portion thereof encoded with frontal sound information and the second portion thereof encoded with ear signals including related HRTF information.

14. A method of reproducing surround sound comprising the steps of:

(a) providing a set of surround sound channel signals having a first portion thereof encoded with frontal sound information including a left front signal and a right front signal originating respectively from a left-aimed microphone and a right-aimed microphone, both located in a front region of a head portion of a microphone support structure, and having a second portion thereof encoded with a left ear signal and a right ear signal originating respectively each from a corresponding one of a pair of microphones located at opposite ear locations of the head portion;

(b) providing, in a listening environment and located to the front of the listener, a set of loudspeakers including a left front loudspeaker and a right front loudspeaker, receiving and reproducing the corresponding left front signal and right front signal from step (a); and (c) providing, in the listening environment and located in proximity to the listener's ears, a set of small loudspeakers located in an aurally transparent manner at an outer region of the listener's ears, receiving and reproducing the second portion of the surround sound channel signals from step (a) including the corresponding left front signal and the fight front signal.

15. The method of reproducing surround sound as defined in claim 14 wherein step (a) comprises the preliminary step of:

(1a') acquiring the set of surround sound signals from a set of microphones in an acoustic space, disposed strategically in close proximity to a head, made, arranged and oriented to provide said set of surround sound signals with the first portion thereof encoded with frontal surround sound information and the second portion thereof encoded with ear signals including related HRTF information.

16. The method of reproducing surround sound as defined in claim 14 wherein step (a) further comprises the preliminary step of:

(1a") synthesizing the set of surround sound signals utilizing audio synthesis and processing equipment made and arranged to synthesize, process and deliver said set of surround sound signals with the first portion thereof encoded with frontal surround sound information and the second portion thereof encoded with ear signals including related HRTF information.

* * * * *